US009950199B2

(12) United States Patent
Skov et al.

(10) Patent No.: US 9,950,199 B2
(45) Date of Patent: Apr. 24, 2018

(54) RESPIRATOR MASK

(71) Applicant: MOLDEX-METRIC, INC., Culver City, CA (US)

(72) Inventors: Torben Skov, Pliezhausen (DE); Frank Kern, Pliezhausen (DE)

(73) Assignee: Moldex-Metric, Inc., Culver City, CA (US)

( * ) Notice: Subject to any disclaimer, the term of this patent is extended or adjusted under 35 U.S.C. 154(b) by 347 days.

(21) Appl. No.: 14/605,789

(22) Filed: Jan. 26, 2015

(65) Prior Publication Data

US 2015/0217144 A1 Aug. 6, 2015

(51) Int. Cl.

| | |
|---|---|
| ***A62B 9/04*** | (2006.01) |
| ***A62B 7/10*** | (2006.01) |
| ***A62B 18/02*** | (2006.01) |
| ***A62B 18/08*** | (2006.01) |
| ***A62B 18/10*** | (2006.01) |
| *A62B 23/02* | (2006.01) |

(52) U.S. Cl.

CPC ..... *A62B 9/04* (2013.01); *A62B 7/10* (2013.01); *A62B 18/02* (2013.01); *A62B 18/025* (2013.01); *A62B 18/08* (2013.01); *A62B 18/084* (2013.01); *A62B 18/10* (2013.01); *A62B 23/02* (2013.01)

(58) Field of Classification Search

CPC ..... A62B 9/04; A62B 7/10; A62B 18/025; A62B 18/08; A62B 18/10; A62B 18/084; A62B 18/02; A62B 23/02; A44B 11/02; A44B 11/04; A44B 11/06; A44B 11/08

See application file for complete search history.

(56) References Cited

U.S. PATENT DOCUMENTS

| | | | | | |
|---|---|---|---|---|---|
| 4,852,563 | A * | 8/1989 | Gross | A61M 16/08 | 128/202.27 |
| 5,062,421 | A * | 11/1991 | Burns | A62B 18/025 | 128/205.27 |
| 5,222,488 | A * | 6/1993 | Forsgren | A62B 19/00 | 128/201.25 |
| 5,579,761 | A * | 12/1996 | Yuschak | A62B 23/02 | 128/201.25 |
| 9,393,448 | B2 * | 7/2016 | Dwyer | A62B 18/02 | |
| 2014/0224256 | A1 * | 8/2014 | Skov | A62B 18/02 | 128/206.17 |

* cited by examiner

*Primary Examiner* — Justine Yu
*Assistant Examiner* — Timothy Stanis
(74) *Attorney, Agent, or Firm* — Charles H. Schwartz

(57) ABSTRACT

The invention relates to a respirator mask having a mask body, at least one exhalation valve and at least one inhalation valve, at least one filter module allocated to the inhalation valve, and at least one coupling element arranged on the mask body and provided to fasten at least one head fastening strap engaging the head of a user from behind. It is provided that the coupling element for fastening the filter module to the mask body in a detachable manner comprises at least one holding projection which can be displaced from a position locking the filter module in place on the mask body to a position releasing the filter module.

9 Claims, 2 Drawing Sheets

RESPIRATOR MASK

This application is based on and claims the benefit of priority from German Patent Application No. 102014001937.3, filed on Feb. 6, 2014, the contents of which are incorporated by reference.

The invention relates to a respirator mask having a mask body, at least one exhalation valve and at least one inhalation valve, at least one filter module allocated to the inhalation valve, and at least one coupling element arranged on the mask body and provided to fasten at least one head fastening strap to the mask body, the head fastening strap engaging the head of a user from behind.

BACKGROUND ART

Respirator masks of the aforementioned type are known from prior art. They are used to protect a user against air pollutants while breathing. A closed gas compartment which is separated from the environment is formed for the user by means of a mask body that can be arranged over the user's mouth and nose. By means of at least one exhalation valve and at least one inhalation valve both of which are arranged on the mask body and penetrate the same, a gas or air exchange can then take place between the user and the environment through the mask body. In addition, the mask bodies, usually, comprise coupling elements wherein one or a plurality of head fastening straps can be fastened to said coupling elements and, when tightened around the back of the user's head, pull the respirator mask against the user's face to ensure that the respirator mask tightly lies against the face.

In order to separate the inhaled air or the air to be inhaled from pollutants if any are present, a filter module through which the air must flow before it reaches the gas compartment and, in particular, the inhalation valve is allocated to the at least one inhalation valve or to each inhalation valve. In order to be able to use the respirator mask over a long period of time, in particular even when the filter modules show signs of ageing, it must be possible to replace the filter modules if necessary. To achieve this, there are various known solutions.

For example, U.S. Pat. No. 5,222,488 discloses a known respirator mask wherein a filter module can be screwed onto a mask body. And U.S. Pat. No. 4,934,361 already discloses a respirator mask wherein the filter module can be fastened to the mask body in a detachable manner by means of a bayonet mount. Furthermore, it is already known from U.S. Pat. No. 4,771,771 to provide a sliding fit device for holding a filter module in a detachable manner.

The known respirator masks have the disadvantage that fastening means that are complex in terms of design must be provided on the mask body to fasten the one or the plurality of filter modules in a detachable manner.

SUMMARY OF THE INVENTION

The invention is, therefore, based on the object to create a respirator mask which obviates the drawbacks mentioned above in a simple and cost-effective manner.

The object forming the basis of the invention is achieved by means of a respirator mask having the features described herein. This respirator mask has the advantage that elements that are usually already provided on the respirator mask are used in a simple manner to ensure that, at the same time, the filter module(s) can be locked in place on the mask body in a detachable manner. Therein, a detachable fastening of the filter module(s) to the mask body is achieved without any major additional effort. The respirator mask according to the invention is characterized in that the coupling element for fastening the filter module to the mask body in a detachable manner comprises at least one holding projection which can be displaced from a position locking the filter module in place on the mask body to a position releasing the filter module. The invention, therefore, provides that a coupling element that is usually present in any event is also used for fastening the filter module. By displacing the holding projection arranged on the coupling element from a locking position to as releasing position, the filter module can be detached from the mask body. By appropriately displacing the holding projection from the releasing position to the locking position, the filter module is fastened to the mask body.

According to a preferred refinement of the invention, it is provided that the coupling element is formed such that it can be elastically deformed at least partially. In this manner, it is advantageously achieved that the holding projection arranged on the coupling element can be displaced from the one to the other position by the elastic deformation of the coupling element. In this manner, a particularly easy implementation of the ability of the holding projection to be displaced is ensured, it is particularly preferred that the coupling element is formed integrally with the mask body or with a mask body part of the mask body that is formed from multiple parts as the case may be.

According to an advantageous refinement of the invention, it is provided that, in addition or as an alternative, the coupling element is mounted by means of a joint on the mask body such that it can be pivoted, in this case, the coupling element is, thus, connected to the mask body in a pivoted manner wherein, in this case, preferably at least one spring element is allocated to the joint, which preferably forces the coupling element with the holding projection into the locking position, with the result that, in the normal state, the filter module is held to the mask body. The same, preferably, is also applicable to the design of the elastically deformable coupling element which, in the locking position, is either relaxed or already pretensioned in order to ensure that the filter module is held to the mask body in a particularly safe and play-free manner.

Preferably, it is provided that the holding projection is formed integrally with the coupling element. This results in a particularly simple and stable arrangement of the holding projection on the coupling element.

According to an advantageous refinement of the invention, it is provided that the holding projection is formed as a detent lug having a stop facing the mask body and having an insertion chamfer facing away from the mask body. The insertion chamfer allows the coupling element to be automatically displaced to the releasing position along with the holding projection when the filter module is brought close to the mask body. Preferably, the mask body comprises an accommodating recess for at least partially receiving the filter module, wherein the filter module can, preferably, be inserted into said accommodating recess true to size, at least in essence. Advantageously, the at least one preferably formed coupling element having the holding projection is provided at the edge of this recess, with the result that, by means of the accommodating recess, the filter module can be safely positioned at the desired point and, by means of the coupling element, the filter module is safety locked in place on the mask body.

Furthermore, it is preferably provided that the coupling element is formed in the shape of an L, having a first leg fastened to the mask body and a second leg facing away from the filter module, wherein the holding projection is arranged on the first leg. The advantageous design ensures simple actuation of the coupling element for detaching the locking mechanism. If a user exerts force on the second leg, for example at the latter's outer end, in the direction of the mask body, i.e. if a user presses on the second leg, the holding projection is pulled away from the filter module and displaced to its released position. To achieve this, the holding projection is, more preferably, arranged at the end of the first leg facing away from the mask body, in order to effect a displacement of the holding projection by actuating the second leg that is as far as possible while exerting only low force.

According to a preferred refinement of the invention, it is furthermore provided that the second leg comprises means for fastening the head fastening strap. Preferably, these means are clamping means which allow clamping the fastening strap to the coupling element or, rather, the second leg of the coupling element. Preferably, the clamping means comprise an elastically deformable ring that can be pushed onto the second leg, as well as a structure on the second leg having at least one recess, preferably a plurality of recesses in the second leg, with the result that, by pushing the ring onto the head fastening strap and the coupling element, the head fastening strap is forced into the recess(es) and, thereby, a high holding force for holding the head fastening strap to the coupling element is ensured.

Furthermore, it is preferably provided that one or a plurality of the coupling elements according to the invention are allocated to the filter module or the respective filter module. According to a first embodiment, it is, for example, provided that the filter module as a whole is held to the mask body by nothing but a plurality of coupling elements according to the invention that are arranged distributed over the circumference of the filter module.

According to a preferred second embodiment, it is provided that one or a plurality of coupling elements such as they have been described above are allocated to the filter module only on one side and that, on a second side disposed opposite the first side, the filter module comprises at least one locking projection which can be/is slid into a locking receptacle of the mask body. Appropriately, the locking projection projects laterally from the filter module, with the result that it can be pushed into the locking recess by a lateral sliding movement. Therein, the locking recess and the locking projection are preferably formed such that the filter module can be tilted while the locking projection is disposed in the locking recess. As a result, the filter module can be put into its position of use by inserting it in a tilted manner into the locking receptacle with the locking projection and subsequently lowering its side projecting from the mask body while the holding projection(s) is/are in their releasing position. Appropriately, it is, herein, provided that, as has been described above, the holding projections are formed as detent lugs, with the result that, initially, the filter module can be inserted into the locking receptacle with the locking projection in a tilted manner and clicked into place in its position of use by subsequently depositing it on the mask body, wherein the coupling elements are automatically displaced to the releasing and, subsequently, to the locking position with the holding projections, this being achieved by means of the spring force or inherent elasticity and the design as a detent lug.

According to an advantageous refinement of the invention, it is furthermore provided that at least one further detent projection, more particularly in the form of a detent lug, that is allocated to the filter module and can be elastically displaced at least in certain areas is assigned to the mask body. The further detent projection differs from the coupling element described above particularly in that it does not comprise any means or options for fastening the head fastening strap. The at least one additional detent projection solely serves to lock the filter module in place on the mask body and, thereby, supports the effect of the one or the plurality of coupling elements according to the invention.

According to a preferred refinement of the invention, it is provided that the filter module and/or the accommodating recess or the mask body, respectively, each comprise at least one sealing web extending in a frame-like manner and spaced apart from the inlet valve. Due to its frame-like shape, the sealing web is formed continuously, i.e. without interruption, and surrounds the inlet valve, at least while the filter module is inserted into the particular accommodating recess. Therein, the sealing web is formed such that, while the filter module is in its inserted state, it rests on the filter module or the latter's filter module bottom and/or on the bottom of the accommodating recess in a sealing manner. To achieve this, the sealing web is, more preferably, formed such that it can be elastically deformed at least partially. Thereby, the sealing web, furthermore, provides a spring force which can be used to safely lock the filter module in place by means of the coupling elements.

Therein, the sealing web, preferably, extends in parallel to the outer contour of the particular accommodating recess. As an alternative, the sealing web can also comprise a form that is independent of or deviating from the outer contour. For example, the sealing web can extend around the inlet valve in the form of a circular ring. Therein, it can particularly be provided that the sealing web is always spaced apart from the lateral walls of the particular accommodating recess. It is also conceivable that the ring form of the sealing web is not circular but, for example, polygonal, for example, square or rectangular or even star-shaped.

According to a preferred refinement of the invention, it is provided that the mask body is formed from multiple parts, having a mask base body and at least one shell element forming the particular accommodating recess, wherein the shell element preferably comprises a higher stiffness than the mask base body. As a result of the formation from multiple parts, the manufacture of the mask body is facilitated. As a result of the formation from multiple parts, it is in addition possible to achieve that the mask base body and the shell element comprise different properties, particularly with regard to their flexibility. By means of the preferred embodiment, according to which the mask base body comprises a higher flexibility than the shell element, it is ensured that, on the one hand, the mask base body comfortably fits to the shape of the user's face and that, on the other hand, the shell element ensures a sufficiently high stiffness for connecting the filter module to the mask body in a safe and tight manner.

BRIEF DESCRIPTION OF DRAWINGS

Below, the invention will be illustrated in more detail by means of the drawings. In the drawings.

FIG. 1 is a perspective view of a respirator mask 1 comprising a mask body 2 which is formed to separate the nose and the mouth of a user from the environment. To achieve this, the mask body 2 comprises a flexible sealing lip 3 which faces the user and fits to the shape of the user's face in a gas-tight manner while the respirator mask 1 is pressed against the user's face. To achieve this, a plurality of coupling elements 4, four in the illustrated instance, are arranged on the mask body 2, the coupling elements 4 comprising means 5 for fastening a head fastening strap 7 that is in particular flexible. Therein, the means 5 are formed on a free pin-shaped end of the particular coupling element 4 as a plurality of recesses 6 extending in transverse direction in relation to the longitudinal extension of the coupling element 4. In order to fasten the head fastening strap 7, a free end of the head fastening strap 7 is laterally applied to the coupling element 4 in the vicinity of the means 5. An elastically deformable ring 8 is then pushed onto the coupling element 4 and the head fastening strap 7 in order to securely clamp the latter to the coupling element 4 in the vicinity of the recesses 6. Therein, the recesses 6 particularly serve to lock the head fastening strap 7 in place on the particular coupling element 4 in a form-locking manner. As shown in FIG. 1, the head fastening strap 7 can also comprise a plurality of free ends each of which is allocated to one of the coupling elements 4, respectively. As an alternative, it is also possible that a plurality of head fastening straps 7 is provided. Usually, the head fastening strap(s) 7 comprise/s a feature for longitudinal adjustment, with the result that, by appropriately adjusting the length, the mask body 2 is pulled towards the user's face in an optimal manner in order to implement the gas-tight connection by means of the sealing lip 3.

Furthermore, an exhalation valve 9 which penetrates the mask body 2 is arranged on the mask body 2. In the illustrated instance, the exhalation valve 9 is covered by a test valve 10 that can be actuated manually and is provided to test the gas-tightness of the respirator mask 1. As usual, the exhalation valve 9 is designed to allow air to escape outwards from the interior region or from the gas compartment formed between the mask body 2 and the face whereas it closes in opposite flow direction, with the result that the user cannot inhale any unfiltered air from the environment through the exhalation valve 9. To achieve this, the exhalation valve comprises a check valve element that can be displaced or elastically deformed.

Figure 1:
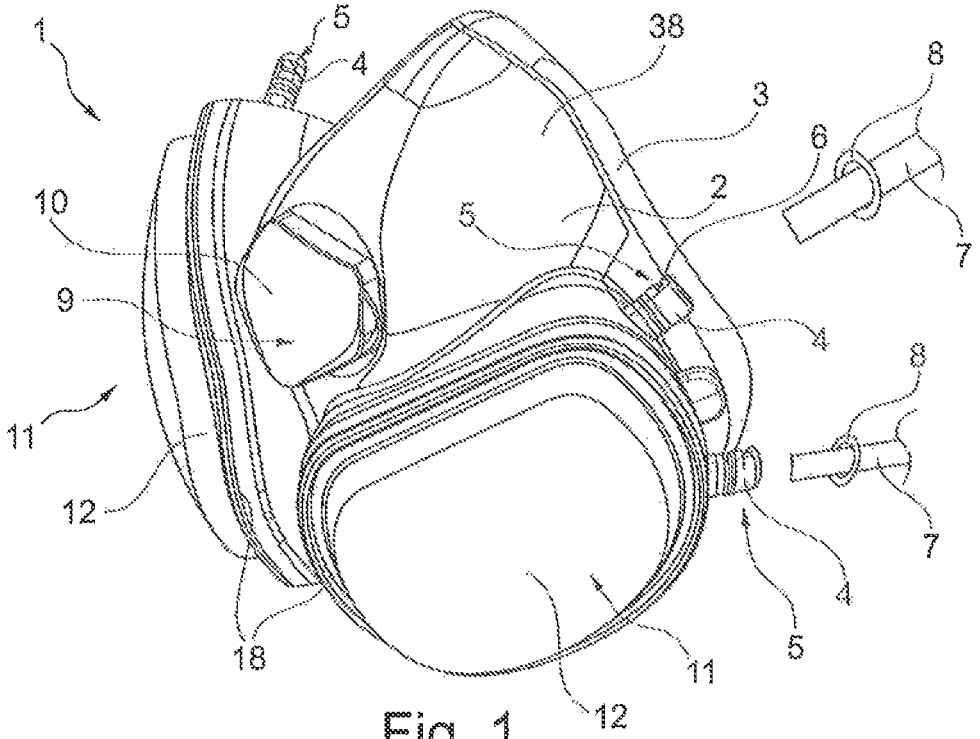
FIG. 1 is a perspective view of a respirator mask with filter modules.

In order to let ambient air into the gas compartment, two inhalation valves 11 are provided in the illustrated instance, which are arranged below the exhalation valve 9 and on the mask body 2 on either side of the valve 9. One filter module 12 that can be or is arranged on the outside of the mask body 2 is allocated to each of the inhalation valves 11, as shown in FIG. 1.

Figure 2:
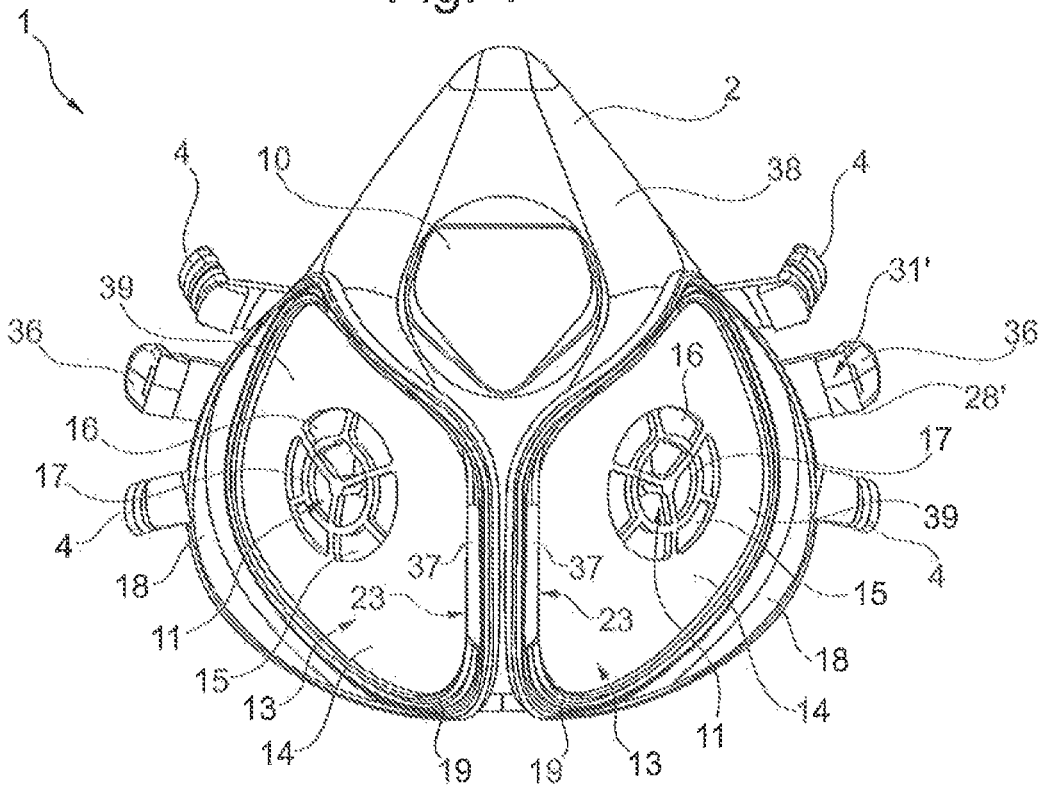
FIG. 2 is a top view of the respirator mask without filter modules.

FIG. 2 is a top view of the respirator mask 1 without filter modules 12. The mask body 2 comprises two accommodating recesses 13 the outer contour of which essentially corresponds to the contour of the filter modules 12, with the result that they can, at least in essence, be inserted into the particular accommodating recess 13 true to size. The particular accommodating recess 13 comprises a bottom 14 in which an opening 15 is formed. Therein, the particular bottom 14 is formed such that it is curved in a plurality of directions in order to achieve advantageous wearing convenience as well as a visually advantageous design of the respirator mask 1. Therein, the particular inhalation valve 11 is allocated to the particular opening 15. Said inhalation valve 11 is formed by a flexible valve element 16 which closes the opening 15 in a sealing manner in the normal state. The valve element 16 is arranged on the rear of the mask body 2, i.e. disposed in the gas compartment, and therefore lies against the rear of the mask body 2 such that it covers the particular opening 15. Therein, the particular opening 15 comprises a grid structure 17 extending across its cross-section wherein the particular valve element 16 is held centrally to said grid structure 17. Therein, the valve elements 16 are formed in the shape of a circular disk and are held to the grid structure 17 only centrally. When the user inhales and a negative pressure develops in the gas compartment of the mask body 2, the particular valve element 16 is deformed inwards into the gas compartment whereby the particular opening 15 is released and the user can inhale the air that is filtered by the particular filter module 12. When the user exhales, the valve elements 16 are forced against the mask body 2 such that they close the particular opening.

The particular accommodating recess 13 is limited by an edge 18 that is continuous at least in essence and extends around the particular inhalation valve 11 in a contour deviating from a circle and spaced apart from said inhalation valve 11. Therein, the contour essentially corresponds to the contour of a rectangle with rounded corners. The particular accommodating recess 13, therefore, essentially comprises four side wall sections two of which are each disposed opposite each other. Furthermore, it is provided that a circumferential sealing web 19 which is particularly designed such that it can be elastically deformed extends on the bottom 14 in each particular accommodating recess 13 in parallel to the particular edge 18. If the particular filter module is inserted into the corresponding accommodating recess 13, it lies against the particular sealing web 19 with its bottom side in a sealing manner, with the result that a sealed air compartment is provided between the filter modules 12 and the particular inlet valve 11, said sealed air compartment ensuring that nothing but air filtered by the particular filter module 12 is supplied to the inhalation valve 11.

The filter modules 12 are held to the mask body 2 in a detachable manner, with the result that they can, for example, be replaced if their effect decreases or if they are increasingly polluted. A detachable locking mechanism of the filter modules 12 that is provided to achieve this will be described in the following.

Figure 3:
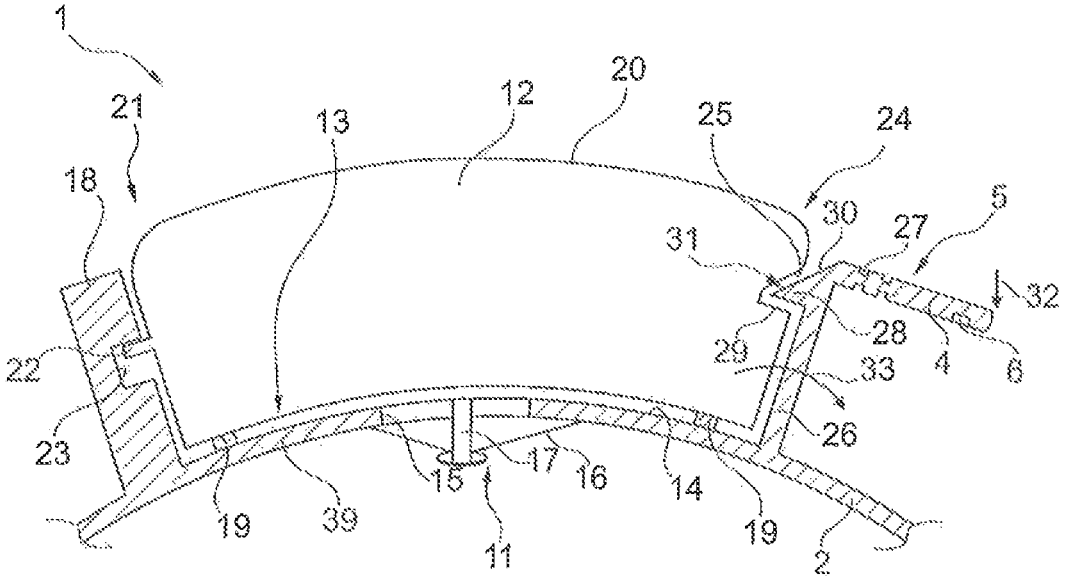
FIG. 3 is a simplified cross-sectional view of the respirator mask with a filter module arranged thereon.

FIG. 3 is a simplified cross-sectional view of the respirator mask 1 showing a longitudinal section of one of the accommodating recesses 13 with a filter module 12 arranged therein, wherein nothing but the outer contour of the filter module 12 is shown in the illustrated instance. Appropriately, the filter module 12 comprises a filter module housing 20 which gives the filter module 12 the corresponding contour. The filter module 12 comprises an outer contour corresponding to the edge 18, which is also different from a circle and is, in essence, formed rectangular with rounded corners, with the result that the filter module 12 also comprises sides two of which are each arranged opposite each other. On one side 21, the filter module 12 comprises a locking projection 22 which projects laterally from the filter module 12. The locking projection 22 rests in a locking receptacle 23 which is formed in the edge 18 of the accommodating recess 13. The projection 22 is pushed into the locking receptacle 23, with the result that the filter module 12 is held in the accommodating recess 13 on the side 21 in a form-locking manner.

On the side 24 disposed opposite the side 21, the filter module housing 20 comprises a recess 25 which is each allocated to one of the coupling elements 4. As can, in essence, be seen from FIGS. 2 to 4, the coupling elements 4 are formed in the shape of an L having a first leg 26 which is connected to the mask body 2, as well as to a second leg 27 which, in the illustrated instance, is aligned at a right angle to the first leg 26 and facing away from the filter module 12 and the accommodating recess 13, respectively. The means 5 that have already been mentioned above and are provided for fastening the head fastening strap 7 are provided on the second leg 27. Appropriately, the leg 26 is formed integrally with the mask body 2 or with a mask body element of the mask body 2 which is, in this case, formed from multiple parts, said mask body element forming the accommodating recess 13 as a whole. At the end of the first leg 26 disposed opposite the mask body 2, i.e. in the area in which the first leg and the second leg 27 meet each other, the first leg 26 comprises a detent lug 28 which laterally projects in the direction of the accommodating recess 13. The detent lug 28 comprises a stop 29 that is in essence flat and faces the mask bottom 2, as well as an insertion chamfer 30 facing away from the mask body 2.

In the state shown in FIG. 3, the detent lug 28 rests partially in the recess 25 of the filter module 12, with the result that the latter is also held to the mask body 2 on the side 24, this being achieved by the detent lug 28 forming a holding projection 31. Therein, the spacing of the holding projection 31 from the bottom 14 of the accommodating recess 13 is selected such that, in the locked state, the filter module 12 rests on the sealing web 19 in a sealing manner. The locking receptacle 23 and the locking projection 22 are formed correspondingly. Therein, the spacings are appropriately selected such that the sealing web 19 is elastically deformed when the filter module 12 is in its locked position, with the result that a spring tension acts on the holding projection 31 as well as the locking projection 22 in order to achieve a self-retention of the locking mechanism. According to an exemplary embodiment that is not shown here, it can, in addition, be provided that the detent lug 28 comprises a projection which faces the mask body 2 and engages behind the filter module housing 20 in order to safely prevent the locking mechanism from detaching unintentionally.

In order to detach the filter module 12 from the mask body 2, the holding projection 31 must be pulled out of the recess 25. Due to the advantageous design of the present respirator mask 1, this can simply be achieved by pressing on the free end of the second leg 27 according to the arrow 32, whereby the elastically deformable leg 26 is bent and the holding projection 31 is pulled out of the recess 25, as is indicated by the arrow 33.

Figure 4:
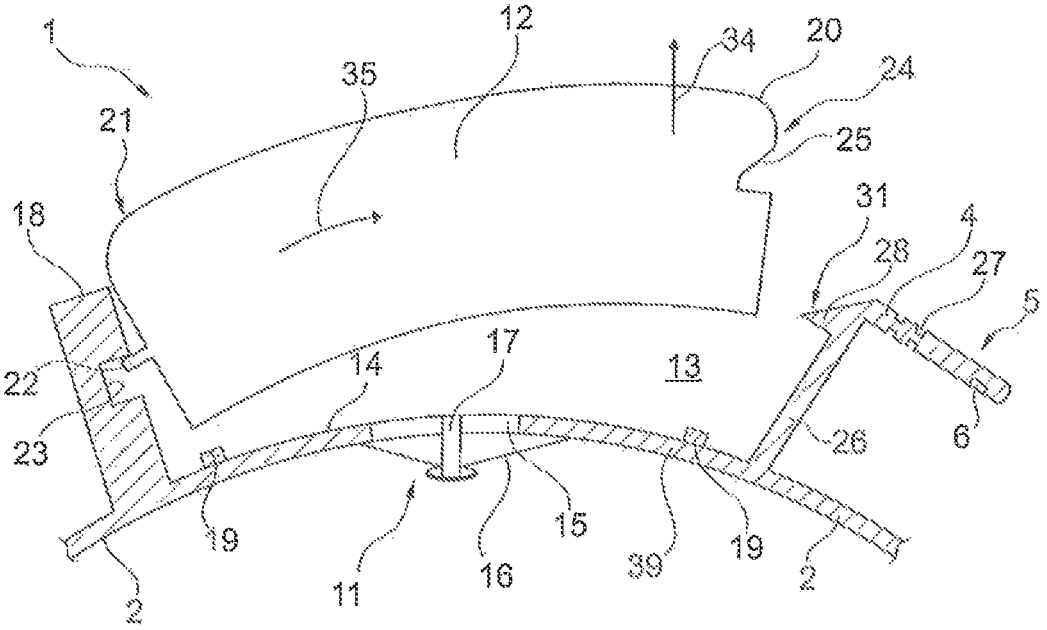
FIG. 4 is a simplified cross-sectional view of the respirator mask with a detached filter module.

In this context, FIG. 4 is the longitudinal sectional view of the respirator mask 1 according FIG. 3, wherein the filter module 12 is detached from the actuated coupling element 4 or from the actuated coupling elements 4. As soon as the particular holding projection 31 has been removed from the recess 25, as shown in FIG. 4, the filter module 12 can be pulled up or away from the accommodating recess 13 by being tilted on the side 24, this being achieved by initially lifting the filter module 12 on the side 24 as indicated by an arrow 34 and subsequently pulling the filter module 12 out of the locking receptacle 23 with the locking projection 22 as indicated by an arrow 35. Therein, the locking receptacle 23 and the locking projection 22 are formed such or are provided with such play that the filter module 12 can be tilted in the locking receptacle 23 with the holding projection 22.

In order to insert the filter module 12 into the particular accommodating recess 13, the filter module 12 is, initially, pushed into the locking receptacle 23 with the locking projection 22 and, subsequently, the side 24 is pressed into the locking receptacle 13. Due to the advantageous design of the holding projection 31 as a detent lug 28 with the insertion chamfer 30, it is therein achieved that, when being pressed in, the particular holding projection 31 is automatically displaced sidewards to a releasing position, as shown in FIG. 4. As soon as the filter module 12 rests on the sealing web 19, the holding projection 31 clicks into place in the recess 25 due to the inherent elasticity of the coupling element 4 and locks the filter module 12 in its position of use.

As can in particular be seen from FIG. 2, two coupling elements 4 are, in the illustrated instance, arranged on the side of the particular accommodating recess 13 that is disposed opposite the locking receptacle 23. As an alternative, it is also possible to provide only one corresponding coupling element 4 or more than two coupling elements 4 per filter module 12. Optionally, it is furthermore provided that an additional detent projection 36 is each provided between the coupling elements 4 that are two in the illustrated instance, said detent projection 36 essentially corresponding to the coupling elements 4 in its layout and structure except for the provision of the means 5. The detent projections 36 also click into place in corresponding recesses of the particular filter module 12 with a holding projection 31' that is, appropriately, formed as a detent lug 28' and can be brought out of engagement by means of elastic deformation. It is also conceivable to form the particular locking receptacle 23 by a projection 37 of the edge 18 projecting into the particular accommodating recess 13, as shown in FIG. 2, instead of by a recess in the edge 18.

All in all it is thereby achieved that the filter modules 12 can be locked in place on the mask body 2 in a simple manner by being clicked or snapped into place in the particular accommodating recess 13. At the same time, the locking mechanism can again be detached in a simple manner by actuating the coupling elements 4 and, if necessary, the detent projections 36.

According to the present exemplary embodiment, it is furthermore provided that the mask body 2 is formed from multiple pieces and, to achieve this, comprises a mask base body 38 as well as two shell elements 39 each of which forms one of the accommodating recesses 13. Therein, the shell elements 39 comprise a higher stiffness than the mask base body 38, in this manner, it is ensured that, on the one hand, the mask base body 38 fits to the shape of a user's face in an advantageous manner and that, on the other hand, the accommodating recesses 13 are formed sufficiently stiff in order to ensure a firm hold of the particular filter module 12.

We claim:

1. A breathing mask, having a mask body, at least one exhalation valve and at least one inhalation valve, at least one filter module allocated to the at least one inhalation valve, and at least one coupling element arranged on the mask body and provided to fasten at least one head fastening strap adapted to engage the head of a user from behind, characterized in that the at least one coupling element comprises at least one holding projection for fastening the at least one filter module to the mask body in a detachable manner, wherein the at least one holding projection is configured to be displaced from a position locking the at least one filter module in place on the mask body to a position releasing the at least one filter module and characterized in that the at least one coupling element is formed such that it is configured to be elastically deformed at least in certain areas, characterized in that the at least one coupling element is formed integrally with the mask body, and characterized in that the at least one holding projection is formed integrally with the at least one coupling element, and characterized in that the at least one holding projection is formed as a detent lug having a stop facing the mask body and an insertion chamfer facing away from the mask body, and characterized in that the at least one coupling element is formed in the shape of an L having a first leg fastened to the mask body and a second leg facing away from the filter module wherein the at least one holding projection is arranged on the first leg at an end of the first leg and facing away from the mask body.

2. The breathing mask according to claim 1, characterized in that the second leg comprises clamping structure for fastening to the at least one head fastening strap.

3. The breathing mask according to claim 1, characterized in that the at least one coupling element includes a plurality of coupling elements is allocated to the at least one filter module.

4. The breathing mask according to claim 3, characterized in that the plurality of coupling elements are allocated to a first side of the at least one filter module and that, on a second side disposed opposite the first side, the at least one filter module comprises at least one locking projection is configured to be pushed into a locking receptacle of the mask body.

5. The breathing mask according to claim 1, characterized in that at least one detent projection is elastically displaced and is allocated to the at least one filter module and is arranged on the mask body for the purpose of locking the at least one filter module.

6. The breathing mask according to claim 1, characterized in that the mask body comprises one receiving recess for the at least one filter module for receiving the at least one filter module in certain areas.

7. The breathing mask according to claim 6, characterized in that the at least one filter module or the receiving recess each comprise at least one sealing web forming a frame and spaced apart from the at least one inhalation valve.

8. The breathing mask according to claim 7, characterized in that the at least one sealing web is formed such that it is configured to be elastically deformed at least in certain areas.

9. The breathing mask according to claim 6, characterized in that the mask body is formed from multiple parts, having a mask base body and at least one shell element forming the receiving recess, wherein the at least one shell element comprises a higher stiffness than the mask base body.

* * * * *